United States Patent [19]

Malchow et al.

[11] Patent Number: 4,553,404

[45] Date of Patent: Nov. 19, 1985

[54] ROOM AIR CONDITIONER WITH HIGH CAPACITY FRESH AIR CIRCULATION MEANS

[75] Inventors: Gregory L. Malchow; Edwin H. Frohbieter, both of Lincoln Township, Berrien County, Mich.

[73] Assignee: Whirlpool Corporation, Benton Harbor, Mich.

[21] Appl. No.: 622,868

[22] Filed: Jun. 20, 1984

[51] Int. Cl.[4] ..... F25D 23/12

[52] U.S. Cl. ..... 62/262; 62/427; 415/148

[58] Field of Search ..... 62/262, 263, 427; 415/148, 151, 157; 98/32

[56] References Cited

U.S. PATENT DOCUMENTS

| | | | |
|---|---|---|---|
| 1,834,959 | 12/1931 | May | 415/157 |
| 2,401,560 | 6/1946 | Graham et al. | 62/262 X |
| 2,542,121 | 2/1951 | Earl | 417/423 |
| 2,654,233 | 10/1953 | Shoemaker | 62/262 |
| 2,782,611 | 2/1957 | Atchison | 62/427 |
| 2,971,351 | 2/1961 | Webster | 62/427 |
| 3,084,522 | 4/1963 | Hames et al. | 62/262 |
| 3,440,946 | 4/1969 | Morrison | 415/157 |
| 3,762,182 | 10/1973 | Loos et al. | 62/262 X |
| 4,135,850 | 1/1979 | d'Anjou | 415/148 |

*Primary Examiner*—Lloyd L. King

*Attorney, Agent, or Firm*—Wood, Dalton, Phillips, Mason & Rowe

[57] ABSTRACT

According to the invention a baffle is provided in a dual inlet air conditioner blower wheel and is selectively movable within the blower wheel between the inlets to adjust the air delivery through the inlets while maintaining a substantially constant total volume delivery. The air mixture is adjustable is desired proportions between full volume indoor and full volume outdoor air and is presented to a blower wheel and centrifugally propelled into a space to be conditioned.

20 Claims, 5 Drawing Figures

FIG. 1
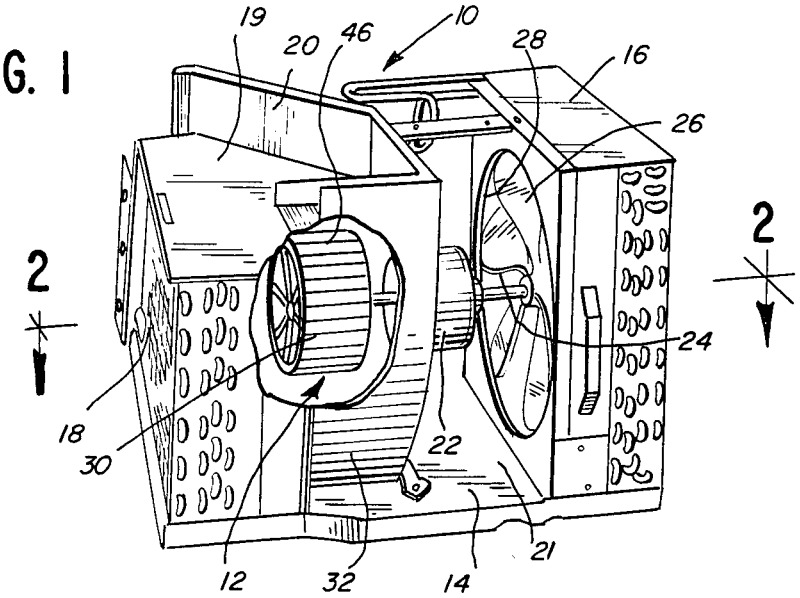
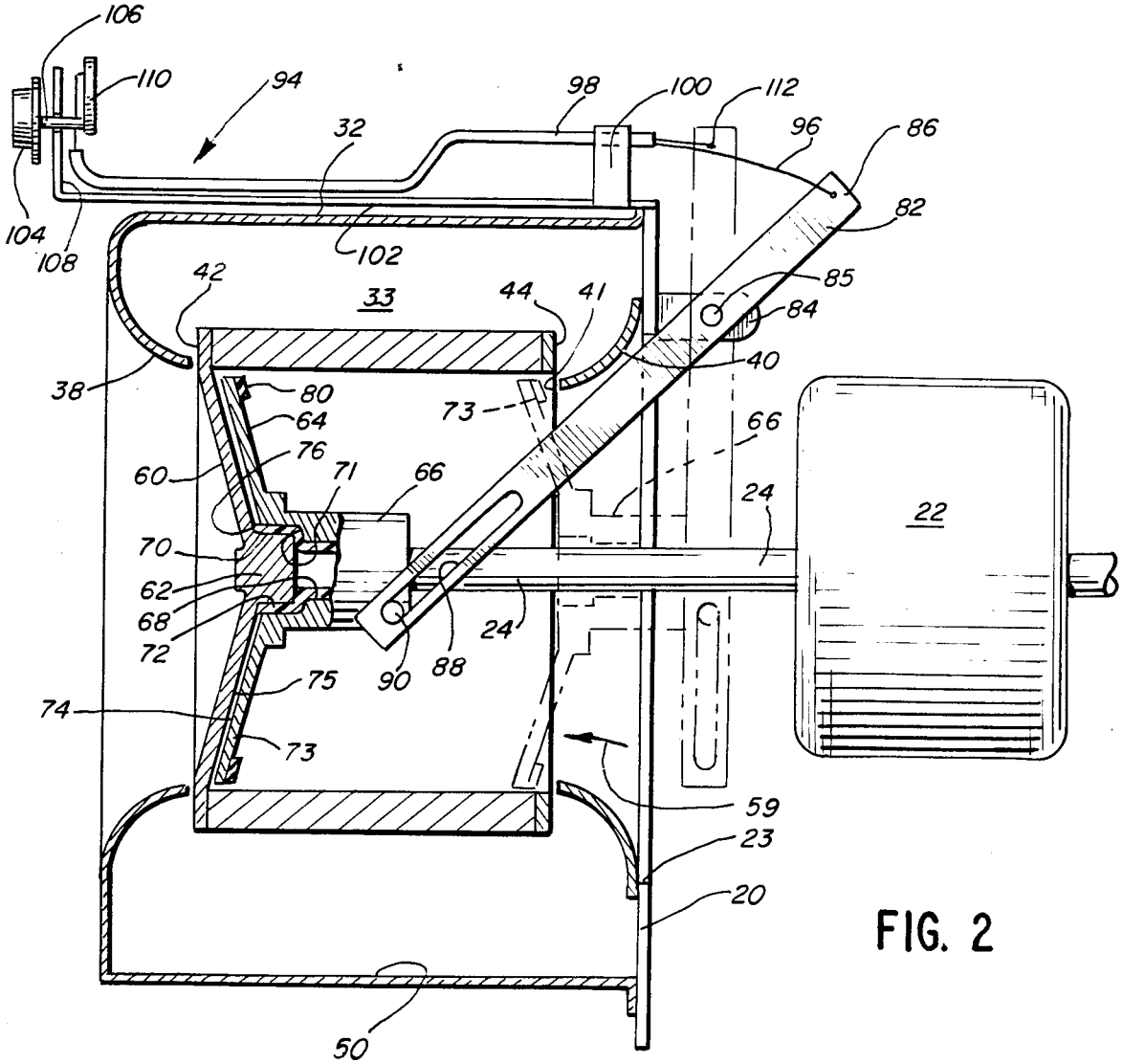
FIG. 2

FIG. 3
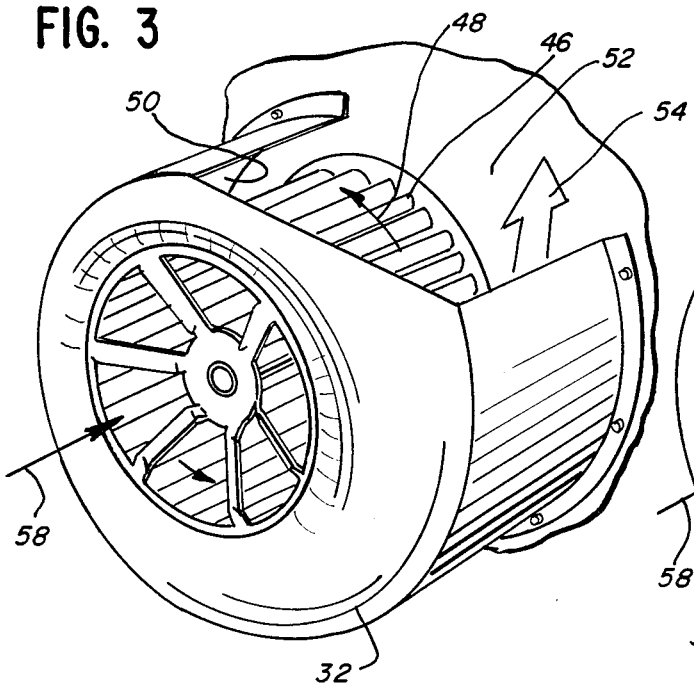
FIG. 4
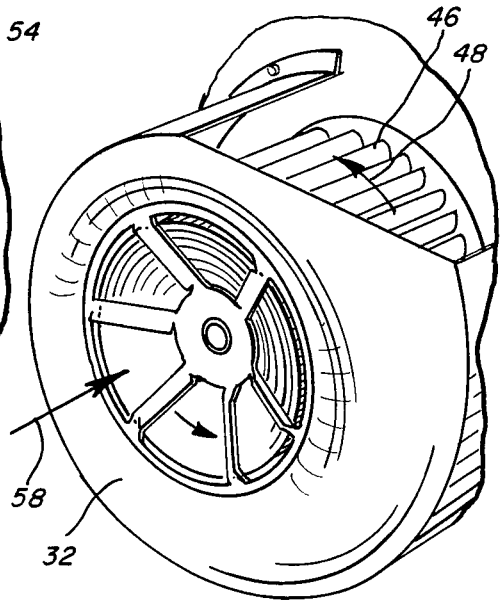
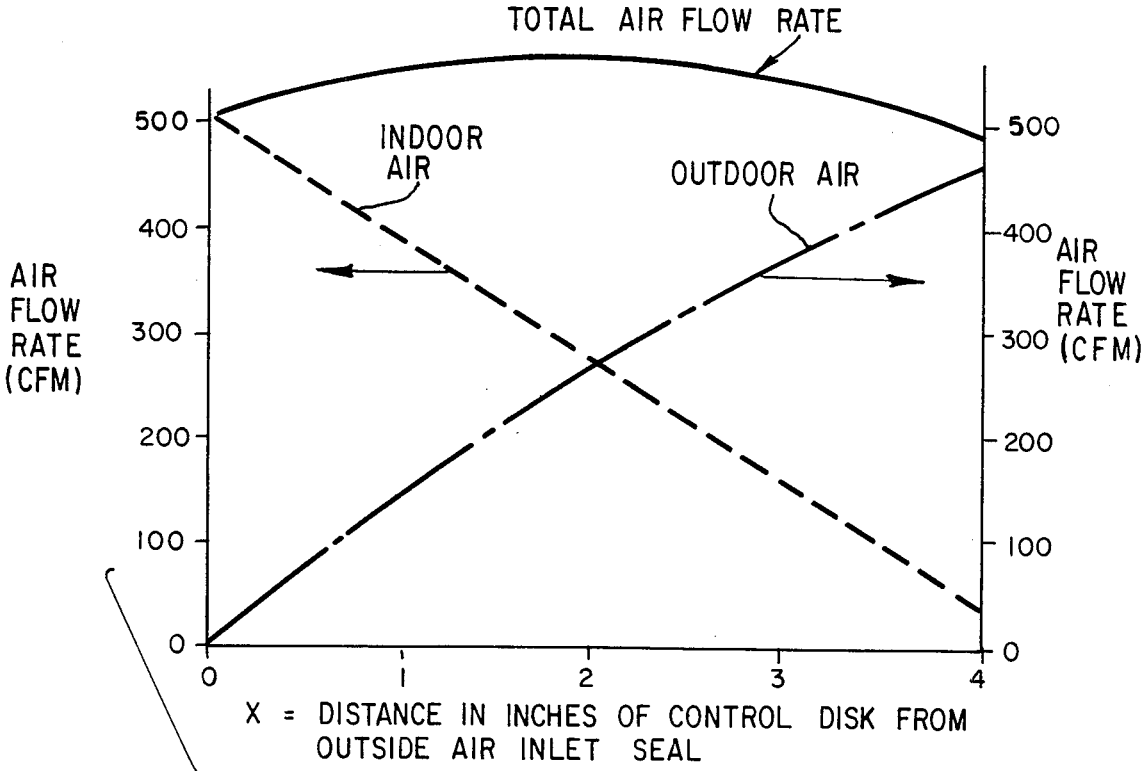
FIG. 5

ROOM AIR CONDITIONER WITH HIGH CAPACITY FRESH AIR CIRCULATION MEANS

BACKGROUND OF THE INVENTION

1. Field of the Invention

This invention relates to air conditioning units and, more particularly, to a means for providing variable proportions of fresh, i.e. outside ambient, and recirculated, i.e. inside space, air between entirely fresh air and entirely recirculated air to a space to be conditioned.

2. Background Art

The provision of outside air to a space to be conditioned through an air conditioning unit is commonly effected when the outdoor temperature and humidity conditions are such that these conditions within the space can be improved. The outside air may be provided selectively with or without refrigeration by the air conditioning unit.

One problem with conventional air conditioning units is that they typically are capable of introducing only a relatively small proportion of outside air to the amount of recirculated inside air. One such conventional unit is shown in U.S. Pat. No. 2,971,351, to Webster.

In Webster, an air conditioner is disclosed having a dual inlet blower section. An adjustable damper disk is provided at the outside air inlet and has ports selectively registrable with ports in a bulkhead to control the effective area of the inlet. No structure is provided for proportioning the amount of recirculated air delivered to the blower relative to the outside air. With this construction, the state of the outside air might dictate high volumetric delivery. However, flow of the recirculated air to the blower limits the flow of outside air thereto so that a mixture of no more than a 50% outside air mixture can be obtained.

An improvement over the Webster structure is disclosed in U.S. Pat. No. 3,440,946, to Morrison wherein an apparatus is provided with a dual inlet blower. In Morrison, spaced damper plates are associated with each of the inlets. The plates are interconnected so that reciprocable shifting of the damper control moves one plate over one inlet to adjustably restrict the same, while the other plate moves equally away from the other inlet to increase air flow.

The size and complexity of the Morrison structure are serious deficiencies with respect to modern window air conditioners. For example, the damper plates obstruct axial flow of air towards either inlet. As a result, to freely pass air through either inlet, the plate associated therewith must be moved a substantial distance away from the inlet opening. Thus, a blower of substantial length must be provided to accommodate sufficient axial shifting to provide the desired flow volume parameters. The need for increasing the blower dimensions, compromises the desirable compactness of the unit.

Further, it is believed that the volume of air flowing through the inlet does not vary gradually and consistently as the disk moves from its fully blocking positions. Rather, at some stage an abrupt change in the air flow occurs. This makes mixing unpredictable and precludes precise selection of inside and outdoor air proportions.

SUMMARY OF THE INVENTION

The present invention comprehends an improved air delivery structure overcoming one or more of the above discussed deficiencies in the prior structures in a novel and simple manner.

In the illustrated embodiment of the invention, a baffle is provided in a dual inlet blower wheel and is selectively movable within the blower wheel between the inlets to control the volume of air flowing through the inlets and the proportions of inside and outside air admitted. The air mixture is presented to the blower wheel and centrifugally propelled through an outlet to the space to be conditioned.

The structure according to the invention is simplified by the requirement of but a single baffle. At the same time, the location of the baffle synchronizes incoming air volume reduction at one inlet with proportionately increased air volume introduction at the other inlet. Precise proportions of air can be chosen and varied gradually and continuously between a full volume air flow condition at either inlet.

Because the baffle operates within the blower wheel, the baffle itself need not extend beyond the axial limits of the blower. As a result, the dimension of the air conditioner in the direction of the length of the blower chamber can be minimized.

Other objects and advantages of the invention will be apparent upon reading the following detailed description taken in conjunction with the drawings and the appended claims.

BRIEF DESCRIPTION OF THE DRAWINGS

FIG. 1 illustrates an uncased, conventional type air conditioner incorporating an adjustable baffle in the blower section according to the present invention;

FIG. 2 is a sectional view of the blower section along line 2—2 of FIG. 1;

FIG. 3 is a fragmentary, perspective view of the blower section with the baffle situated for air flow entirely from one inlet;

FIG. 4 is a view similar to that in FIG. 3 with the baffle adjusted for air flow entirely from the inlet opposite that in FIG. 3; and FIG. 5 is a graphic illustration of the air flow rate in relation to the position of the baffle.

DETAILED DESCRIPTION OF THE DRAWINGS

To demonstrate the invention, a portable air conditioning unit designated 10 is illustrated in FIG. 1, absent a protective sheet metal outer cabinet. The invention is embodied in a dual inlet blower section at 12. The operation of the unit 10, with the exception of the blower 12, is for the most part conventional.

The unit 10 comprises a flat, rigid supporting base 14 for a condenser unit 16 and evaporator unit 18, which units are normally respectively situated indoors and outdoors and separated by a vertical bulkhead 20. The bulkhead 20 partitions the unit to define a heat absorbing inside compartment at 19 and a heat dissipating outside compartment at 21.

A motor 22 has a shaft 24 extending through an enlarged aperture 23 (FIG. 2) in the bulkhead, and is keyed to simultaneously rotate a propeller type fan 26 in a recess 28 adjacent the condenser 16 and a cylindrical blower wheel 30 in the blower section 12. The fan 26 draws outdoor air through louvers on the sides of the outer cabinet (not shown) into the outside air compartment 21 and directs the outdoor air for exhaustion from the unit through a suitable grille (not shown) adjacent the outer surface of condenser 16. A screen (not shown)

may be situated over the cabinet inlet louvers to filter debris which could otherwise be admitted.

The blower section 12, which is the focus of the present invention, is detailed in FIGS. 1–4. A blower wheel housing 32 defines a cylindrical blower chamber 33 within which the blower wheel is rotatably accepted. A conventional peripheral outlet from the chamber is established radially outwardly of the wheel, as best seen in FIGS. 1, 3 and 4.

The depicted blower is of dual inlet construction, and cooperates with an annular indoor air inlet 38 and an annular outdoor air inlet 40 of substantially equal diameter. The walls about the leading edges of each inlet 38, 40 are curved and converge in the direction of flow to funnel the air supply to the blower. The diameter of the bulkhead aperture 23 corresponds substantially to the widest section of the inlet 40.

The blower wheel 30 is a centrifugal type. The wheel 30 comprises first and second axially spaced frame rings 42, 44 between which a plurality of blades 46 are mounted in an annular array. The blades are commonly pitched about their length to attack the air in the intended direction of rotation of the blower wheel as indicated by the arrow 48 in FIGS. 3 and 4. As the wheel rotates, the blades push the air in peripheral outgoing fashion from the chamber 33 and compress the air against the inside wall 50 of the blower housing 32. The pressurized air in the housing is expelled upwardly through an opening 52 generally in the direction of the arrow 54 for discharge from the air conditioner into the space being cooled.

As the wheel 30 rotates, suction is developed tending to draw the air axially through the inlets in the direction of arrow 58 in FIG. 3 and arrow 59 in FIG. 2. This drawing action is assisted by providing radially extending spokes 60 between a hub 62, to which the shaft 24 is keyed and the ring 42. The spokes 60 each comprise a pitched body which operates as a tiny propeller as the wheel 30 rotates. The spokes 60 make an angle of less than 90° with the axis of the shaft 24 and cooperatively define an inwardly opening, cupshaped configuration.

The details of the invention are most clearly evident from FIG. 2. The invention resides in the provision of a baffle 64 having a cylindrical hub 66 with a through bore 68 to accept the shaft 24 associated with the motor. The hub 66 has an enlarged bore 70 partially along its length to fit the hub 62 of wheel 30 and define an annular shoulder 71 which abuts a metal sleeve bearing 72 carried by the blower wheel hub 62 to arrest shifting of the baffle at the full volume outside air position depicted in FIG. 1. Sleeve bearing 72 is interposed between the hub 66 and the shaft 24 and hub 62 to minimize wear on the baffle hub, which is preferably made from polypropylene.

The baffle has a frusto-conical disk 73 integral with and extending radially outwardly from the hub 66. The inwardly facing surface 74 of the disk 73 conforms closely to the contour of the facing wall defined by the spokes 60 on the wheel and closely aligns therewith in the full volume outdoor air position of FIG. 2. Overextension of the baffle 64 and unwanted binding between the baffle and wheel 30 are prevented by the above-described abutment of the baffle hub shoulder 71 with the sleeve bearing 72 which, in turn, abuts the blower wheel hub 62.

In operation, the baffle is movable between the FIG. 2 solid line position and its full volume indoor air position shown in dotted lines, toward the right in that figure, wherein the hub 66 extends through the aperture 23 in the bulkhead. In the solid line position, the introduction of room air is effectively prevented because the air cannot reach the peripheral portion of the blower wheel. Consequently, the full volume of air moved by the blower wheel is supplied from the outside inlet. Upon achieving the dotted line position in FIG. 2, the baffle seals the outdoor air inlet 40 about its inner edge 41 so that the blower wheel moves only indoor air. The seal is enhanced by providing a foam gasket 80 in captured relationship between the disk 73 and the annular edge 34.

By moving the baffle between the inlets, the effect of one inlet increases while the effect of the opposite inlet decreases proportionately. FIG. 5 demonstrates the relative proportions of inside and outside air as a function of the position of the frusto-conical disk 73. It can be seen that the proportions of indoor and outdoor air vary inversely and continuously in substantially linear fashion upon shifting the baffle. Precise proportions of indoor and outdoor air can be chosen, depending on the outdoor conditions to maximize comfort in the conditioned space. The variable X in FIG. 5 is represented schematically relative to the blower section B in relationship to the driving motor M.

The continuous adustability is made possible by selecting the length and diameter of the blower wheel so that flow is not inlet limited. This requires that the area of the inlet be sufficiently large in comparison to the effective peripheral outlet area of the blower so that additional air can be delivered through the inlet as the baffle is moved away from that inlet to a position at least half way between the inlets.

To control movement of the baffle, an operating link 82 is provided. The link 82 is pin connected to a post 84, which is fixedly attached to the bulkhead 20, for rotation about an axis 85 transverse to its length and towards its outer end 86. The link 82 is provided with an elongate slot 88 at a point remote from the outer end 86. The slot accepts and guides a pin 90 associated with the hub 66 of the baffle. The connection between the link 82 and the pin 90 prevents rotation of the baffle 64 with the motor shaft 24. Upon pivoting the link 82 in a counterclockwise fashion about the pivot axis 85, the pin 90 is translated lengthwise in the slot 88 to effect axial shifting of the baffle. The baffle realizes the dotted line position in FIG. 2 when the link is substantially parallel to the bulkhead 20.

Manual operation of the link 82 is accomplished through a cable control at 94. The control 94 comprises a sheathed cable 96 with the sheath 98 mounted on an anchoring post 100 associated with an extension 102 of the bulkhead 20. A control knob 104, positioned for indoor accessibility, is keyed to a shaft 106 journalled for rotaton on a control panel 108. An arm 110, fixed to the shaft 106, accepts a turned end of the cable at a position off center of the shaft axis so as to convert rotation of the knob into sliding movement of the cable 96 within the sheath 98. The end of the cable opposite the turned cable end is offset and extends through an aperture 112 in the link 82. Rotation of the knob 104 selectively situates the baffle in the range between the solid line and dotted line positions depicted in FIG. 2. Pivoting of the link is limited by the pin 90 encountering the ends of the guide slot 88 in both the full inside air and full outside air modes.

It should be understood that the foregoing detailed description was made for purposes of clarifying the structure and operation of the invention, with no unnecessary limitations to be derived therefrom.

Having described the invention, the embodiments of the invention in which an exclusive property or privilege is claimed are defined as follows:

1. In a room air conditioner having means defining an indoor section and an outdoor section, a blower housing disposed within said indoor section and having an indoor air inlet, an outdoor air inlet and an air outlet, improved means or selectively delivering desired proportions of indoor and outdoor air to said outlet comprising:

a centrifugal blower wheel rotatably mounted within said blower housing, said blower wheel defining an axis of rotation and having a first inlet communicating with said indoor air inlet and a second axially spaced inlet communicating with said outdoor air inlet;

a movable air baffle positioned within said blower wheel for movement along said blower wheel axis; and mounting means for adjustable positioning said baffle at any of various locations along said axis to vary the ratio of the axial length of the blower acting on the indoor air to the axial length of the blower acting on the outdoor air to thereby accurately control the proportion of indoor air and outdoor air delivered to said outlet.

2. The air conditioner of claim 1 wherein said movable air baffle comprises a substantially imperforate disklike member.

3. In a room air conditioner having means defining an indoor section and an outdoor section, a blower housing disposed within said indoor section and having an indoor air inlet, an outdoor air inlet and an air outlet, improved means for selectively delivering desired proportions of indoor and outdoor air to said outlet comprising:

a blower wheel rotatably mounted within said blower housing, said blower wheel defining an axis of rotation and having a first inlet communicating with said indoor air inlet and a second axially spaced inlet communicating with said outdoor air inlet;

a movable air baffle positioned within said blower wheel for movement along said blower wheel axis; and mounting means for adjustably positioning said baffle at any of various locations along said axis to thereby control the proportion of indoor air and outdoor air delivered to said outlet, said movable air baffle being movable between a first position wherein said first blower inlet is substantially sealed and a second position wherein said second blower inlet is substantially sealed.

4. In an air conditioner of the type having indoor and outdoor sections, an evaporator associated with the indoor section, a condenser associated with the outdoor section, a blower section associated with the evaporator and having a generally cylindrical chamber with an outlet and indoor and outdoor air inlets spaced axially of the chamber, means for conducting indoor air to said indoor inlet, means for conducting outdoor air to said outdoor inlet, a centrifugal blower means for delivering indoor and outdoor air from said chamber to said outlet, and motor means for operating said blower means, improved means for selectively controlling the proportions of inside and outside air delivered to said outlet, comprising:

baffle means within the blower means for controlling proportions of air from the indoor and outdoor air inlets delivered to said outlet; and means mounting the baffle for adjustment axially within said blower means to vary the ratio of the axial length of the blower acting on the indoor air to the axial length of the blower acting on the outdoor air and thereby cause the proportion of inside and outside air delivered from the blower chamber to the evaporator section to be accurately adjusted as a function of the axial position of said baffle means within the blower means.

5. An air conditioner according to claim 4, wherein said motor means has a shaft keyed to said blower means, and said baffle mounting means mounts said baffle means rotatably relative to said shaft.

6. An air conditioner according to claim 4 wherein said motor means has a shaft keyed to said blower means and said baffle means includes a hub portion within which said shaft is journalled for rotation and a frusto-conical disk portion extending radially from said hub portion.

7. An air conditioner according to claim 4 wherein said blower means comprises a rotatable wheel, said wheel has a plurality of radially extending spokes adjacent at least one of said indoor and outdoor air inlets and said spokes are pitched to draw air toward said blower chamber from said one air inlet upon rotation of the blower wheel.

8. An air conditioner according to claim 4 wherein means are provided to cooperate with said baffle means in an indoor mode to completely seal said outdoor air inlet so that the air discharged from the blower chamber is entirely indoor air.

9. An air conditioner according to claim 4 wherein said motor means has a shaft keyed to said blower means and said baffle means has a hub slidable along the shaft to axially adjust the baffle in the blower means.

10. An air conditioner according to claim 4 wherein said blower means comprises a rotatable wheel, said motor means has a shaft keyed to said rotatable wheel and means are provided to prevent rotation of said baffle upon rotation of the blower wheel.

11. An air conditioner according to claim 4 wherein said blower means comprises a rotatable wheel, a blower housing defines said blower chamber and said housing defines axially spaced edges which confine the axial shifting of the baffle in said blower wheel.

12. In an air conditioner of the type having indoor and outdoor sections, an evaporator associated with the indoor section, a condenser associated with the outdoor section, a blower section associated with the evaporator and having a cylindrical chamber with an outlet and indoor and outdoor air inlets spaced axially of said chamber, a blower wheel rotatably mounted in the blower chamber for conducting indoor air through said indoor inlet and chamber to said outlet and outdoor air through said outdoor inlet and chamber to said outlet, and a motor means for operating said blower wheel, improved means for selectively controlling the proportions of inside and outside air delivered to said outlet, comprising:

a baffle disposed within the blower wheel, said baffle defining a wall with an indoor surface for directing indoor air and an outdoor surface for directing outdoor air;

means mounting the baffle within the blower wheel for axial movement between said indoor and outdoor inlets; and means for adjusting the axial position of the baffle within the blower wheel to vary the ratio of the axial length of the blower acting on the indoor air to the axial length of the blower acting on the outdoor air, whereby the respective volumes of indoor and outdoor air delivered to said outlet are accurately adjustable in an inversely proportionate manner by axial movement of said baffle within the blower wheel.

13. In an air conditioner of the type having indoor and outdoor sections, an evaporator associated with the indoor section, a condenser associated with the outdoor section, a blower section associated with the evaporator and having a cylindrical chamber with an outlet and indoor and outdoor air inlets spaced axially of said chamber, a blower wheel rotatably mounted in the blower chamber for conducting indoor air through said indoor inlet and chamber to said outlet and outdoor air through said outdoor inlet and chamber to said outlet, and a motor means for operating said blower wheel, improved means for selectively controlling the proportions of inside and outside air delivered to said outlet, comprising:

a baffle disposed within the blower wheel, said baffle defining a wall with an indoor surface for directing indoor air and an outdoor surface for directing outdoor air;

means mounting the baffle within the blower wheel for axial movement between said indoor and outdoor inlets; and means for adjusting the axial position of the baffle within the blower wheel, whereby the respective volumes of indoor and outdoor air delivered to said outlet are adjustable in an inversely proportionate manner by axial movement of said baffle within the blower wheel, said motor means having a shaft and said baffle having a hub slidable along the shaft, and further including a pivotally mounted manually operable link which is coupled to said hub, said hub moving axially in response to pivoting of said link.

14. An air conditioner according to claim 12 wherein said motor means has a shaft, said baffle has a hub slidable along the shaft and said hub is made at least partially from a polypropylene material.

15. An air conditioner according to claim 12 wherein said blower chamber is defined by a blower housing and said blower housing defines an abutting edge for said baffle adjacent at least one said indoor and outdoor air inlets so as to provide a complete seal against air passage into the blower chamber from the one air inlet with said baffle in abutting relationship with said edge.

16. In a room air conditioner having means defining an indoor section and an outdoor section, a blower housing disposed within said indoor section and having an indoor air inlet, an outdoor air inlet and an air outlet, improved means for selectively delivering desired proportions of indoor and outdoor air to said outlet comprising:

a blower wheel rotatably mounted within said blower housing, said blower wheel defining an axis of rotation and having a first inlet communicating with said indoor air inlet and a second axially spaced inlet communicating with said outdoor air inlet;

a movable air baffle positioned within said blower wheel for movement along said blower wheel axis; and mounting means for adjustably positioning said baffle at any of various locations along said axis to thereby control the proportion of indoor air and outdoor air delivered to said outlet, said blower chamber being defined by a blower housing, said blower housing defining an abutting edge for said baffle adjacent at least one said indoor and outdoor air inlets so as to provide a complete seal against air passage into the blower chamber from the one air inlet, and a deformable member is interposed between said baffle and abutting edge to provide an effective seal therebetween with the baffle against said edge.

17. An air conditioner according to claim 12 wherein said blower chamber is defined by a housing and said housing has a portion cooperating with the baffle when the baffle is adjusted to close the outdoor inlet to completely seal against the communication of air between the blower chamber and the outdoor air inlet so that the air communicating between the blower chamber and conditioned space is entirely indoor air.

18. In a room air conditioner having means defining an indoor section and an outdoor section, a blower housing disposed within said indoor section and having an indoor air inlet, an outdoor air inlet and an air outlet, improved means for selectively delivering desired proportions of indoor and outdoor air to said outlet comprising:

a blower wheel rotatably mounted within said blower housing, said blower wheel defining an axis of rotation and having a first inlet communicating with said indoor air inlet and a second axially spaced inlet communicating with said outdoor air inlet;

a movable air baffle positoned within said blower wheel for movement along said blower wheel axis; and mounting means for adjustably positioning said baffle at any of various locations along said axis to thereby control the proportion of indoor air and outdoor air delivered to said outlet, said baffle carrying a fixed pin, said means for adjusting the axial position of the baffle comprising a link pivotally connected at a first position to the air conditioner and having an elongate slot at a second position spaced from said first position for guidingly receiving the pin on the baffle, said link pivoting about said first position to effect axial shifting of the baffle in the blower wheel.

19. In a room conditioner having means defining an indoor section and an outdoor section, a blower housing disposed within said indoor section and having an indoor air inlet, an outdoor air inlet and an air outlet, improved means for selectively delivering desired proportions of indoor and outdoor air to said outlet comprising:

a blower wheel rotatably mounted within said blower housing, said blower wheel having a cylindrical discharge surface defining an axis of rotation for said blower wheel, a first inlet communicating with said indoor air inlet and a second axially spaced inlet communicating with said outdoor inlet;

a movable air baffle positioned within said blower wheel for axial movement along said axis of rotation, said air baffle extending generally radially outward toward said discharge surface; and mounting means for adjustably positioning said baffle at selective locations along said axis to thereby vary the ratio of the axial length of the portion of said discharge surface presented to said indoor inlet to the axial length of the portion of said discharge surface presented to said outdoor inlet, whereby the proportion of indoor air and outdoor air delivered to said outlet can be accurately varied accordingly.

20. In an air conditioning apparatus having means defining an inlet chamber defining a discharge area through which air is conducted from said chamber to an outlet, the improvement comprising:

means for infinitely adjustably dividing said chamber to define an infinitely adjustable first portion communicating only with an adjusted first portion of said discharge area and a complementary infinitely adjustable second portion communicating only with the remainder of said discharge area; and means for delivering air having a first characteristic to only said first chamber portion and air having a second, different characteristic to only said second chamber portion.

* * * * *